US009039956B2

(12) United States Patent
Matsumoto et al.

(10) Patent No.: US 9,039,956 B2
(45) Date of Patent: May 26, 2015

(54) COOLING SYSTEM FOR HOT-ROLLED STEEL STRIP

(75) Inventors: Koichi Matsumoto, Hiroshima (JP); Yuji Ikemoto, Hiroshima (JP); Yoichi Haraguchi, Tokyo (JP); Kazuaki Kobayashi, Tokyo (JP)

(73) Assignees: MITSUBISHI-HITACHI METALS MACHINERY, INC., Tokyo (JP); NIPPON STEEL & SUMITOMO METAL CORPORATION, Tokyo (JP)

( * ) Notice: Subject to any disclaimer, the term of this patent is extended or adjusted under 35 U.S.C. 154(b) by 162 days.

(21) Appl. No.: 13/825,373

(22) PCT Filed: Sep. 5, 2011

(86) PCT No.: PCT/JP2011/070107

§ 371 (c)(1),
(2), (4) Date: Jun. 6, 2013

(87) PCT Pub. No.: WO2012/039270

PCT Pub. Date: Mar. 29, 2012

(65) Prior Publication Data

US 2013/0249150 A1 Sep. 26, 2013

(30) Foreign Application Priority Data

Sep. 22, 2010 (JP) ..... 2010-211538

(51) Int. Cl.
*C21D 1/667* (2006.01)
*B21B 39/16* (2006.01)
(Continued)

(52) U.S. Cl.
CPC ..... *C21D 1/667* (2013.01); *B21B 39/16* (2013.01); *B21B 45/0218* (2013.01); *B21B 45/0233* (2013.01); *B21B 2027/103* (2013.01)

(58) Field of Classification Search
CPC ..... C21D 1/667
USPC ..... 266/46; 72/201
See application file for complete search history.

(56) References Cited

U.S. PATENT DOCUMENTS 4,403,492 A 9/1983 Hope
4,741,193 A * 5/1988 Kimura et al. ..... 72/201
(Continued)

FOREIGN PATENT DOCUMENTS

EP 0 745 440 A1 12/1996
JP 62-41404 U 3/1937
(Continued)

OTHER PUBLICATIONS

International Search Report mailed Sep. 27, 2011 for International Application No. PCT/JP2011/070107.
(Continued)

*Primary Examiner* — Scott Kastler
(74) *Attorney, Agent, or Firm* — Birch, Stewart, Kolasch & Birch, LLP

(57) ABSTRACT

Provided is a cooling system for a hot-rolled steel strip capable of increasing the cooling rate for rapidly cooling a rolled steel immediately after rolling and suitable for an apparatus for manufacturing a hot-rolled steel strip having a fine-grained structure. For this purpose, guides (16A, 16B) having guiding surfaces (16*a*, 16*b*) to guide a rolled steel (W) exiting work rolls (12A, 12B) in the conveyance direction are provided at exits of the work rolls in a final stand (Sn) of a finish rolling mill line in a manner that the guides can follow a change in the diameter of the work rolls, a number of injection holes (21A, 21B) are formed in the guides, and a number of rolled steel cooling nozzles (23A, 23B) are provided to spray a large amount of cooling water through the injection holes directly onto the rolled steel.

5 Claims, 7 Drawing Sheets

(51) Int. Cl.
*B21B 45/02* (2006.01)
*B21B 27/10* (2006.01)

(56) References Cited

U.S. PATENT DOCUMENTS

| | | | | |
|---|---|---|---|---|
| 6,006,574 | A * | 12/1999 | Armenat et al. | 72/201 |
| 8,394,318 | B2 * | 3/2013 | Kobayashi et al. | 266/46 |
| 2009/0255311 | A1 | 10/2009 | Schulmeister et al. | |
| 2010/0024504 | A1 * | 2/2010 | Armenat et al. | 72/201 |

FOREIGN PATENT DOCUMENTS

| | | | |
|---|---|---|---|
| JP | 58-138505 | A | 8/1983 |
| JP | 60-43434 | A | 3/1985 |
| JP | 62-7247 | B2 | 2/1987 |
| JP | 4-60304 | U | 5/1992 |
| JP | 8-323405 | A | 12/1996 |
| JP | 2002-273501 | A | 9/2002 |
| JP | 2005-193258 | A | 7/2005 |
| JP | 2005-342767 | A | 12/2005 |
| JP | 2006-35233 | A | 2/2006 |
| JP | 2009-526653 | A | 7/2009 |

OTHER PUBLICATIONS

Extended European Search Report dated Nov. 17, 2014 for related Application No. EP 11 82 6716.

* cited by examiner

COOLING SYSTEM FOR HOT-ROLLED STEEL STRIP

TECHNICAL FIELD

The present invention relates to a cooling system for a hot-rolled steel strip, and particularly to a cooling system suitable for use in an apparatus for manufacturing a hot-rolled steel strip made of a fine-grain structure where a grain size of a ferrite structure is, for example, 3 to 4 μm or less.

BACKGROUND ART

As the cooling system for a hot-rolled steel strip, there are ones disclosed, for example, in Patent Literatures 1 to 3. Specifically, Patent Literature 1 describes a system including a first cooling apparatus arranged immediately after a last stand of a finishing mill line of hot rolling equipment. The first cooling apparatus includes: nozzles for forming a band-like or oblong jet impingement area on a surface, which is to be cooled, of a steel plate; and a damming roll for damming cooling water jetted from the nozzles. In this system, a pool of the cooling water is formed in an area between a roll of the last stand and the damming roll, and the damming roll is arranged such that the steel plate, transported through the first cooling apparatus, is immersed in the cooling water of the pool.

Further, Patent Literature 2 describes an online cooling system including multiple cooling units arranged in a conveyance direction. Each of the cooling units includes: multiple rotating rolls for pressing a thick steel plate from above and below; cooling water headers arranged above and below the thick steel plate; and a large number of nozzles provided in the cooling water headers. On the delivery side of each cooling unit, liquid jet nozzles are arranged at predetermined intervals in a longitudinal direction of each cooling water header extending in a strip-widthwise direction, and slit nozzles for air jetting are arranged in the vicinities of the liquid jet nozzles, so as to prevent cooling water from diffusing on the delivery side of each of the cooling units.

Further, Patent Literature 3 describes an apparatus where a pair of work rolls, which come into contact with a rolled plate, are constituted as extremely-small diameter rolls or different-diameter rolls. This apparatus is provided with: a roll cooling device for jetting a spray of water to a surface of each of the work rolls; and a plate cooling device for jetting a spray of water from a surface of the steel plate on the delivery side of the work rolls toward a contact point between the steel plate and the work rolls. This apparatus is also provided with a water cutoff device which is brought into contact with the surfaces of the work rolls or is separated from the surfaces thereof, thereby shutting off or opening the passage of the spray water to the surface of the steel plate.

A hot-rolled steel strip (steel plate) made of fine-grained steel is well known to have excellent mechanical properties, such as strength and toughness, from Patent Literature 3 mentioned above and Patent Literature 4 mentioned later, and the like. This provides such effects as reducing the weight of a device or an apparatus formed of the hot-rolled steel strip and reducing consumption energy by the weight reduction, and therefore has drawn attention from the industry.

Then, Patent Literature 3 states "Patent Literature 1 (referred to as Patent Literature 5 in this document) discloses a rolling mill for manufacturing a hot-rolled steel plate (steel strip) made of fine-grained steel in hot rolling by a so-called high reduction rolling method where a rolled plate is subjected to intensive cooling while being subjected to rolling at a high reduction rate (high reduction) during hot rolling."

That is, structural refinement is achieved by high reduction, and a rolled plate that generates working heat according to high reduction is kept in a suitable temperature range (around an $Ar_3$ transformation point) by intensive cooling, and grain growth is thereby stopped, and a fine-grained steel hot-rolled steel plate is thus obtained.

Further, Patent Literature 4 states that a hot-rolled steel strip made of a fine-grained structure, where a grain size of a ferrite structure is 3 to 4 μm or less for example, is obtained by: performing hot rolling on a steel containing 0.3% by weight or less of C and 3% by weight or less of alloy elements other than C in the process of cooling the steel from a temperature range of the $Ar_3$ transformation point or more; in the final stage, applying hot rolling on the steel, with a total surface reduction rate of 50% or more to 95% or less, once or more than once substantially within one second in a temperature range of ($Ar_1$+50° C.) to ($Ar_3$+100° C.); and performing cooling to a temperature range of 600° C. or less at a cooling rate of 20° C./s or more to 2000° C./s or less after the hot rolling.

CITATION LIST

Patent Literature

Patent Literature 1: Japanese Patent Application Laid-Open No. 2005-342767

Patent Literature 2: Japanese Patent Application Laid-Open No. S60-43434

Patent Literature 3: Japanese Patent Application Laid-Open No. 2005-193258

Patent Literature 4: Japanese Examined Patent Application No. S62-7247

Patent Literature 5: Japanese Patent Application Laid-Open No. 2002-273501

SUMMARY OF INVENTION

Technical Problem

As described above, it is known that a hot-rolled steel strip made of a fine-grained structure is experimentally obtained by rapidly cooling steel at a cooling rate of, for example, about 1000° C./s after high reduction. If this hot-rolled steel strip can be industrially obtained, a high-tensile steel of high quality or the like can be easily manufactured at a very low cost without adding an alloy element or the like.

It should be noted that a cooling system for rapid cooling is required to increase the rate of cooling a rolled material to, for example, about 1000° C./s immediately after rolling by such a method as jetting a large amount of cooling water directly to the rolled material.

The above conventional cooling system, however, is insufficient in cooling capacity, or is large in scale, resulting in an increase in cost, and therefore has not been realized as an actual apparatus for manufacturing a hot-rolled steel strip made of a fine-grained structure.

That is, in the cooling system described in Patent Literature 1, a non-cooling area, where a measuring device is arranged, is provided between the first cooling apparatus and a second cooling apparatus. For this reason, a large number of nozzles are required to be arranged in the vicinity of the delivery side of the work rolls in order to obtain a predetermined cooling capacity (12000 kcal/h·m2·° C. or more), and also a guide having a guide face is required to be provided. Patent Literature 1, however, contains no description of the guide.

Further, in the cooling system of Patent Literature 2, since multiple cooling units are arranged in the conveyance direction, cooling is not performed immediately after rolling. In addition, since the rolls are arranged at intervals about 1.1 to 1.3 times the roll diameter, a sufficient number of nozzles cannot be arranged, and a sufficient cooling rate cannot be obtained accordingly. Therefore, it is practically impossible to apply the cooling system described in Patent Literature 2 to an apparatus for manufacturing a hot-rolled steel strip made of a fine-grained structure.

Further, in the cooling system described in Patent Literature 3, a rolled material cooling nozzle is arranged on the delivery side of the work rolls. However, since a wiper is not provided with a jet hole for jetting cooling water directly to the rolled material to cool the rolled material, an area where the rolled material cannot be cooled exists below (or above) the installation place of the wiper. Therefore, a sufficient cooling rate cannot be achieved.

In view of the above-described circumstances, an objective of the present invention is to provide a cooling system for a hot-rolled steel strip that is capable of increasing the cooling rate of a rolled material immediately after rolling, and rapidly cooling the rolled material, and that is suitable for an apparatus for manufacturing a hot-rolled steel strip made of a fine-grained structure.

Solution to Problem

The present invention to achieve the above objective is a cooling system for a hot-rolled steel strip, wherein a guide is provided on a delivery side of a work roll in a last stand of a hot finishing mill line so as to be capable of following a variation in the diameter of the work roll, the guide having a guide face for guiding a rolled material, leaving from the work roll, in a conveyance direction of the rolled material, a large number of jet holes are formed in the guide, and rolled material cooling nozzles are provided to jet cooling water directly to the rolled material through the jet holes.

Further, roll cooling nozzles are provided, on the delivery side of the work roll, for jetting cooling water to the work roll, and a separating member is provided for preventing the cooling water, jetted from the roll cooling nozzles, from hitting the rolled material through the jet holes of the guide.

Further, the separating member is made of a flexible member which is connected, at one end thereof, to the guide so as to be capable of allowing the following action of the guide.

Further, the guide is swingably supported at least by a nozzle block to which the rolled material cooling nozzles are attached, and the guide is capable of advancing and retreating relative to the work roll via the nozzle block.

Further, the rolling mill is a cross mill crossing the work roll.

Further, a position adjusting apparatus making the guide capable of following the crossing state of the work roll is provided, and the position adjusting apparatus also has a function serving as a mechanism to cause the guide to advance to and retreat from the work roll.

Advantageous Effects of Invention

According to the cooling system for a hot-rolled steel strip having the above-described configurations according to the present invention, since a large amount of cooling water is jetted directly to the rolled material from the large number of rolled material cooling nozzles through the jet holes of the guide, the cooling rate of the rolled material immediately after rolling increases, so that the rolled material can be rapidly cooled.

Therefore, the rapid cooling after high reduction makes it possible to industrially obtain a hot-rolled steel strip made of a fine-grained structure, so that a high-tensile steel of high quality or the like can be easily manufactured at a very low cost without adding an alloy element or the like.

DESCRIPTION OF EMBODIMENT

Hereinafter, examples of a cooling system for a hot-rolled steel strip according to the present invention will be described in detail with reference to the drawings.

Example 1

Figure 1:
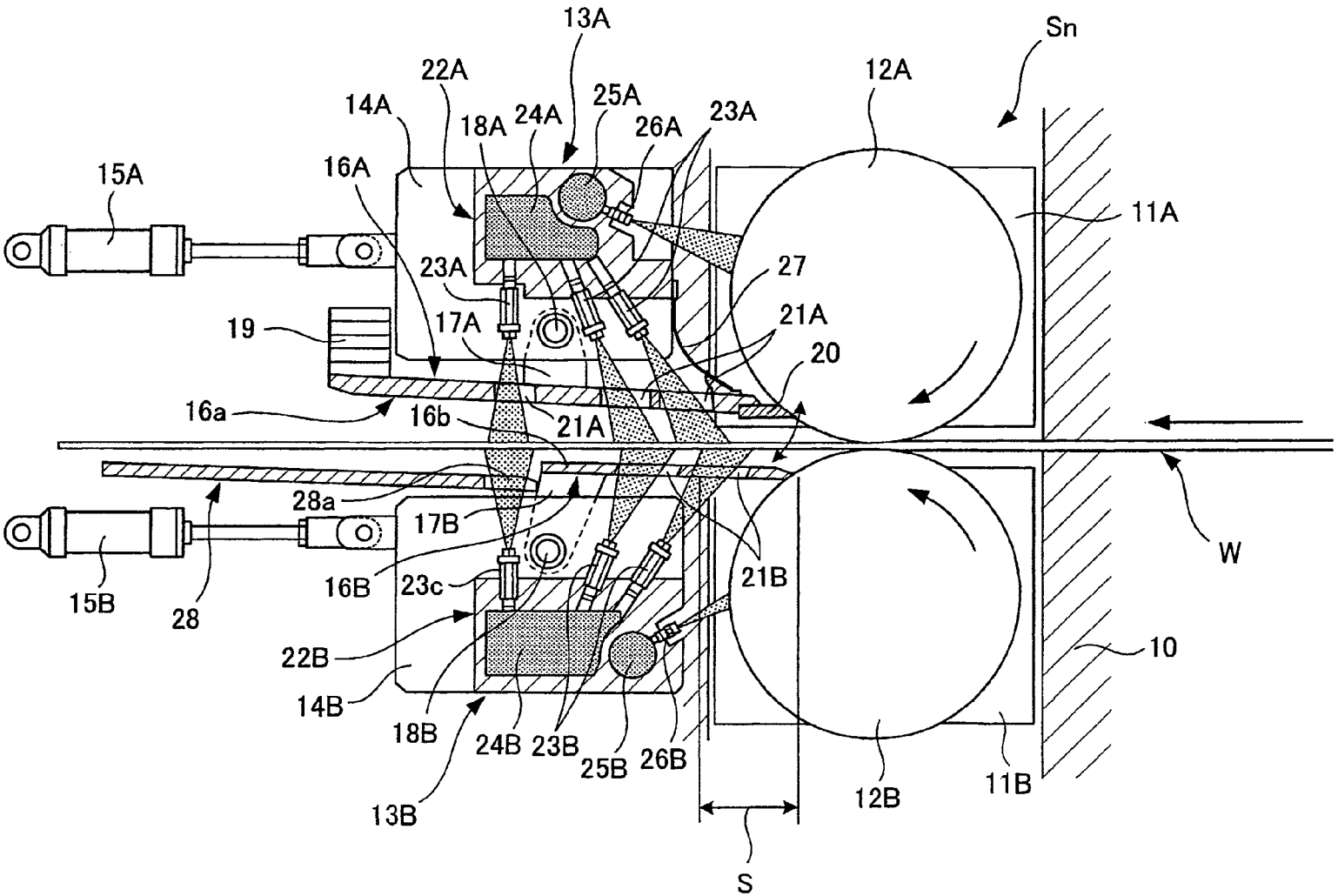
FIG. 1 is a sectional side view of a cooling system for a hot-rolled steel strip showing Example 1 of the present invention.
Figure 2:
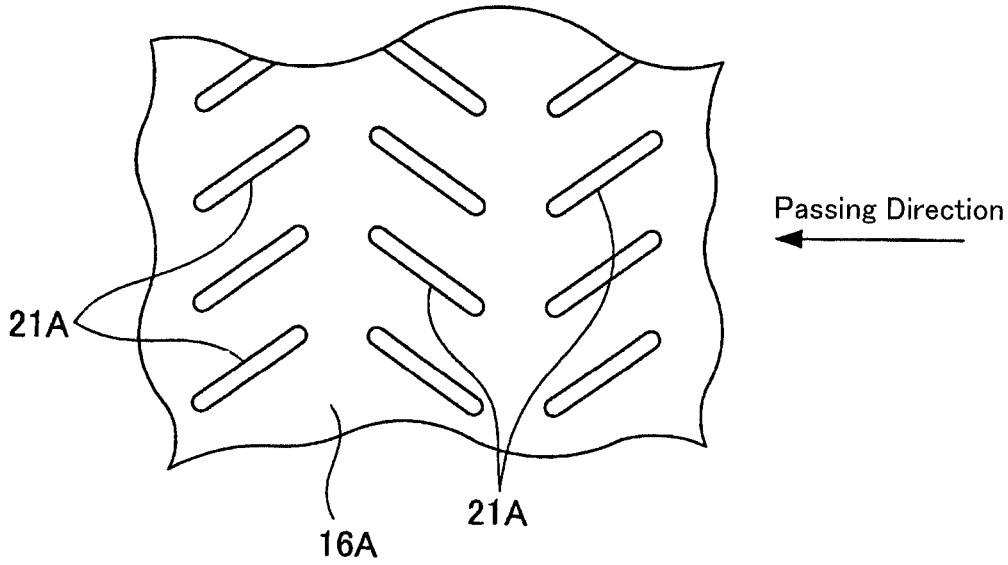
FIG. 2 is a plan view of an upper guide.
Figure 3A:
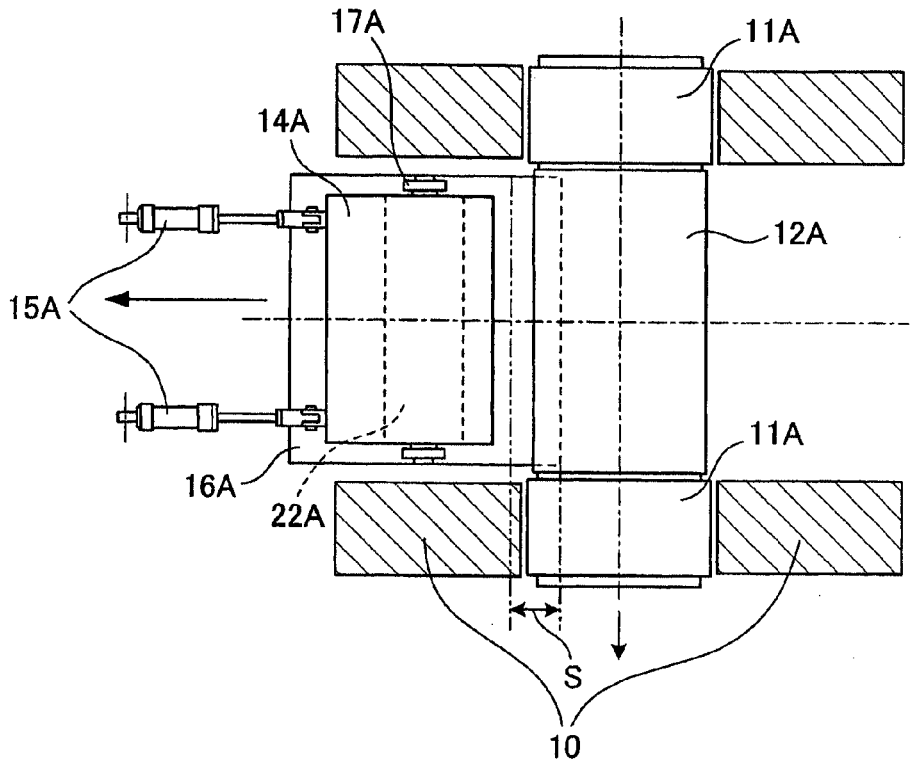
FIG. 3A is a plan view of the upper guide during rolling.
Figure 3B:
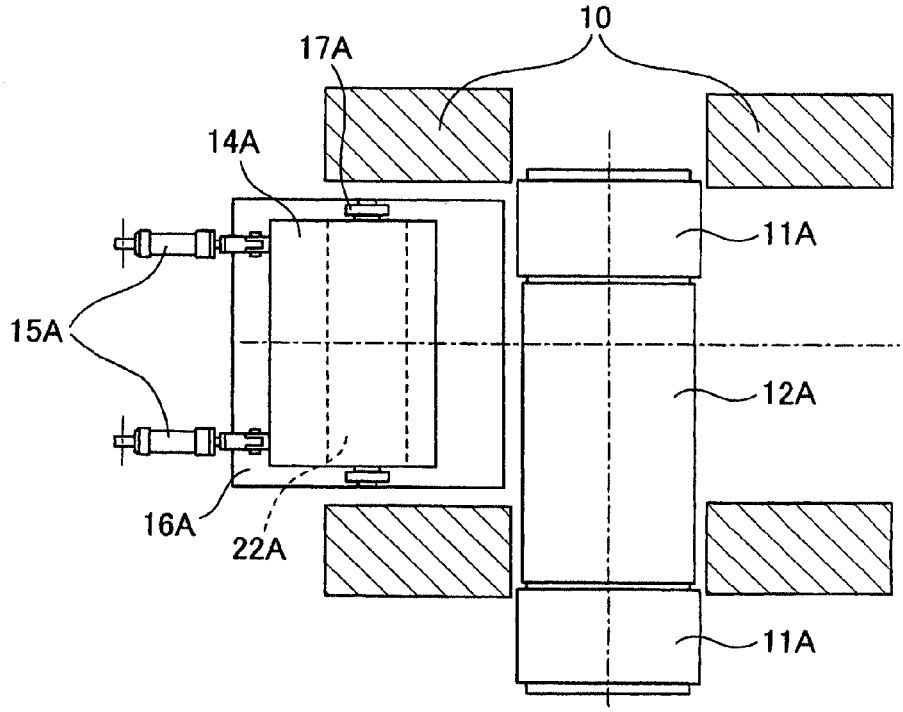
FIG. 3B is a plan view of the upper guide at the time of roll changing.

FIG. 1 is a sectional side view of a cooling system for a hot-rolled steel strip showing Example 1 of the present invention, FIG. 2 is a plan view of an upper guide, FIG. 3A is a plan view of the upper guide during rolling, and FIG. 3B is a plan view of the upper guide at the time of roll changing.

As shown in FIG. 1, in a last stand Sn in a finishing mill line of hot rolling mill equipment, an upper work roll 12A is supported in a housing 10 via a pair of right and left upper work roll chocks 11A so as to be rotatable by an unillustrated motor, and a lower work roll 12B is similarly supported in the housing 10 via a pair of right and left lower work roll chocks 11B so as to be rotatable by an unillustrated motor. An upper cooling apparatus 13A and a lower cooling apparatus 13B are arranged above and below a rolled material W on the delivery side of the upper work roll 12A and the lower work roll 12B.

Further, the upper and lower work rolls 12A and 12B, as shown in FIG. 3B described later, are replaceable together with the upper and lower work roll chocks 11A and 11B from the housing 10 in a state where the upper and lower work rolls 12A and 12B are supported by the upper and lower work roll chocks 11A and 11B, respectively.

In the upper cooling apparatus 13A, a nozzle block 14A, which is long in a strip-widthwise direction of the rolled material W, is supported on both its right and left sides by the housing 10 so as to be slidable in a conveyance direction of the rolled material W. The nozzle block 14A is capable of advancing and retracting relative to the work roll 12A according to extending and retracting actions of a pair of right and left hydraulic cylinders 15A which have piston rods coupled, at the distal ends thereof, to a back face of the nozzle block 14A via pins (advancing and retreating mechanism).

A plate-like guide 16A is provided below the nozzle block 14A so as to be capable of following a variation in the diameter of the upper work roll 12A. The guide 16A is made of a hard material and has a guide face 16*a* for guiding the rolled material W, leaving from the upper and lower work rolls 12A and 12B, in the conveyance direction.

Specifically, the guide 16A is swingably coupled by pins 18A to a lower portion of the nozzle block 14A via brackets 17A at middle portions of both right and left sides of the guide 16A. The guide 16A is urged by a weight 19 placed on a proximal end of the guide 16A, such that a soft plate 20 attached to a distal end of the guide 16A is always brought in contact with a surface of the upper work roll 12A.

A large number of jet holes 21A are opened in the guide 16A, as shown in FIG. 2. In the example shown in FIG. 2, a large number of slit-like jet holes 21A, which are arranged in the strip-widthwise direction of the rolled material W and inclined at predetermined angles, are formed in three rows in the conveyance direction of the rolled material W with alternately changed directions of inclination. The present invention, however, is not limited to this. The number, the number of rows, the shape, the arrangement, and the like, of the jet holes 21A may be selected in each case depending on a cooling water jet nozzle to be used.

Then, a cooling water header 22A is incorporated in the nozzle block 14A. Rolled material cooling nozzles 23A, the number of which corresponds to the jet holes 21A, are attached to the cooling water header 22A to face downward so as to jet a large amount of cooling water directly to an upper face of the rolled material W through the jet holes 21A. The rolled material cooling nozzles 23A communicate with a header portion for rolled material cooling water 24A. The header portion for rolled material cooling water 24A is supplied with high-pressure cooling water from an unillustrated source of cooling water.

Further, a header portion for work roll cooling water 25A is integrally formed in the cooling water header 22A, such that cooling water in the header portion for work roll cooling water 25A is jetted to the surface of the upper work roll 12A from roll cooling nozzles 26A attached to the cooling water header 22A. A large number of the roll cooling nozzles 26A are provided in the strip-widthwise direction of the rolled material W. Further, the header portion for work roll cooling water 25A is supplied with high-pressure cooling water from an unillustrated source of cooling water.

Further, a separating plate (separating member) 27 is extended between a front face of the nozzle block 14A and the distal end of the guide 16A. The separating plate 27 is for preventing the cooling water, jetted from the roll cooling nozzles 26A, from dropping on the upper face of the rolled material W through the jet holes 21A of the guide 16A. The separating plate 27 is made of a flexible member, such as a rubber plate, capable of allowing the following action (swinging) of the guide 16A.

On the other hand, in the lower cooling apparatus 13B, a nozzle block 14B, which is long in the strip-widthwise direction of the rolled material W, is supported on both its right and left sides by the housing 10 so as to be slidable in a conveyance direction of the rolled material W. The nozzle block 14B is thus capable of advancing and retracting relative to the work roll 12B according to extending and retracting actions of a pair of right and left hydraulic cylinders 15B which have piston rods coupled, at the distal ends thereof, to a back face of the nozzle block 14B by pins (advancing and retreating mechanism).

A plate-like guide 16B is provided above the nozzle block 14B so as to be capable of following a variation in the diameter of the lower work roll 12B. The guide 16B is made of a soft material and has a guide face 16*b* for guiding the rolled material W, leaving from the upper and lower work rolls 12A and 12B, in the conveyance direction.

Specifically, the guide 16B is swingably coupled by pins 18B to an upper portion of the nozzle block 14B via brackets 17B at proximal ends of both right and left sides of the guide 16B. The guide 16B is configured such that a distal end of the guide 16B is always brought in contact with a surface of the lower work roll 12B by its own weight. It should be noted that the soft plate 20 is not attached to the distal end of the guide 16B, unlike the distal end of the guide 16A; the soft plate 20 is attached to the distal end of the guide 16B, like the guide 16A, when the guide 16B is made of hard material.

A large number of jet holes 21B are opened in the guide 16B, like the guide 16A described above. For example, a large number of slit-like jet holes 21B, which are arranged in the strip-widthwise direction of the rolled material W and inclined at predetermined angles, are formed in two rows in the conveyance direction of the rolled material W with different directions of inclination. The present invention, however, is not limited to this. The number, the number of rows, the shape, the arrangement, and the like, of jet holes 21B may be selected in each case depending on a cooling water jet nozzle to be used.

Then, a cooling water header 22B is incorporated in the nozzle block 14B. Rolled material cooling nozzles 23B, the number of which corresponds to the jet holes 21B, are attached to the cooling water header 22B to face upward so as to jet a large amount of cooling water directly to a lower face of the rolled material W through the jet holes 21B. The rolled material cooling nozzles 23B communicate with a header portion for rolled material cooling water 24B. The header portion for rolled material cooling water 24B is supplied with high-pressure cooling water from an unillustrated source of cooling water.

Further, a header portion for work roll cooling water 25B is integrally formed in the cooling water header 22B, such that cooling water in the header portion for work roll cooling water 25B is jetted to the surface of the lower work roll 12B from roll cooling nozzles 26B attached to the cooling water header 22B. A large number of the roll cooling nozzles 26B are provided in the strip-widthwise direction of the rolled material W. Further, the header portion for work roll cooling water 25B is supplied with high-pressure cooling water from an unillustrated source of cooling water.

It should be noted that since a large amount of cooling water is jetted in rapid cooling, drainage of the cooling water might be difficult. On the other hand, since part of the cooling water jetted from a rapid cooling apparatus penetrates the vicinity of a delivery side of a roll bite during rapid cooling, the rolls are also cooled in the vicinity of the delivery side of the bite, in addition to roll cooling. In such a case, the amount of water to be drained from the mill can be reduced by reducing excessive cooling water for roll cooling. On the upper face side, the amount of cooling water flowing out from widthwise ends of the cooling apparatus can be reduced. On the lower face side, a jet of roll cooling water blocks drainage water flowing down through the openings of the guide 16B, a space between the guide 16B and the lower work roll 12B, or the like, but the influence of the jet of roll cooling water can be reduced.

Further, the reference sign 28 in FIG. 1 denotes a fixed guide. The cooling water in the header portion for rolled material cooling water 24B is directly jetted to the lower face of the rolled material W from a rolled material cooling nozzle 23C through notches 28*a* in a distal end of the fixed guide 28. A large number of the notches 28*a* are formed in the strip-widthwise direction of the rolled material W.

With this configuration, during rolling (including threading), the extending actions of the hydraulic cylinders 15A and 15B move the nozzle blocks 14A and 14B of the upper and lower cooling apparatuses 13A and 13B to an advanced position shown in FIGS. 1 and 3A, thereby bringing the distal ends of the guides 16A and 16B, supported on the nozzle blocks 14A and 14B by the pins 18A and 18B, into contact with the surfaces of the upper and lower work rolls 12A and 12B, respectively.

This prevents the rolled material W from winding around the upper work roll 12A or the lower work roll 12B during threading, and prevents a leading end of a following rolled material W from winding around the upper work roll 12A or the lower work roll 12B in the case of strip breakage.

Further, since the guides 16A and 16B are supported on the nozzle blocks 14A and 14B by the pins 18A and 18B and are swingable, even when roll changing (that is frequently performed) shown in FIG. 3B or the like causes a change in the diameters of the upper and lower work rolls 12A and 12B, the guides 16A and 16B can follow this change such that the distal ends of the guides 16A and 16B are always brought in contact with the surfaces of the upper and lower work rolls 12A and 12B, respectively. As another method of the following action, it is also possible to change retraction amounts of the hydraulic cylinders 15A and 15B according to the change in the diameters of the upper and lower work rolls 12A and 12B. In this case, the swinging function is unnecessary, and therefore the structure can be simplified.

It should be noted that, at the time of roll changing, as shown in FIG. 3B, the retracting actions of the hydraulic cylinders 15A and 15B move the nozzle blocks 14A and 14B of the upper and lower cooling apparatuses 13A and 13B to a retreated position, thereby separating the distal ends of the guides 16A and 16B, supported on the nozzle blocks 14A and 14B by the pins 18A and 18B, from the surfaces of the upper and lower work rolls 12A and 12B (see a travel distance (advance/retreat amount) S at the time of roll changing in FIGS. 1 and 3A), so that interference in a removal directions of the upper and lower work roll chocks 11A and 11B (the strip-widthwise direction of the rolled material W) is avoided.

Then, in Example 1, a large amount of cooling water is jetted directly to the upper and lower faces of the rolled material W, from the large number of rolled material cooling nozzles 23A, 23B, and 23C, through the jet holes 21A and 21B of the guides 16A, 16B and the notches 28*a* of the fixed guide 28, during rolling. Accordingly, the cooling rate of the rolled material W immediately after the rolling is raised to, for example, a cooling rate of about 1000° C./s, so that the rolled material W can be rapidly cooled.

Therefore, the rapid cooling after high reduction by the finishing mill line makes it possible to industrially obtain a hot-rolled steel strip made of a fine-grained structure, so that a high-tensile steel of high quality or the like can be easily manufactured at a very low cost without adding an alloy element or the like.

Further, in Example 1, the header portions for work roll cooling water 25A and 25B are integrally formed in the cooling water headers 22A and 22B, and the cooling water in the header portions for work roll cooling water 25A and 25B are jetted to the surfaces of the upper and lower work rolls 12A and 12B by the roll cooling nozzles 26A and 26B. Accordingly, the upper and lower work rolls 12A and 12B are also cooled, and thermal deformation of the rolls or the like is avoided.

In addition, since the header portions for rolled material cooling water 24A and 24B and the header portions for work roll cooling water 25A and 25B are integrated into the single cooling water headers 22A and 22B, the nozzle blocks 14A and 14B can be made compact.

Further, the separating plate. (separating member) 27 is extended between the front face (a face opposite the work roll) of the nozzle block 14A and the distal end of the guide 16A in the upper cooling apparatus 13A. Accordingly, when jetting of the cooling water from the header portions for rolled material cooling water 24A and 24B is stopped so that rolled material is not cooled, that is, in normal (ordinary) rolling which does not manufacture a hot-rolled steel strip made of a fine-grained structure, the cooling water jetted from the roll cooling nozzles 26A can be prevented from dropping on the upper face of the rolled material W through the jet holes 21A of the guide 16A, so that reduction in quality of the rolled material W is avoided. In addition, since the separating plate 27 is made of a flexible member such as a rubber plate, the separating plate 27 can allow the following action (swinging) of the guide 16A.

Figure 6:
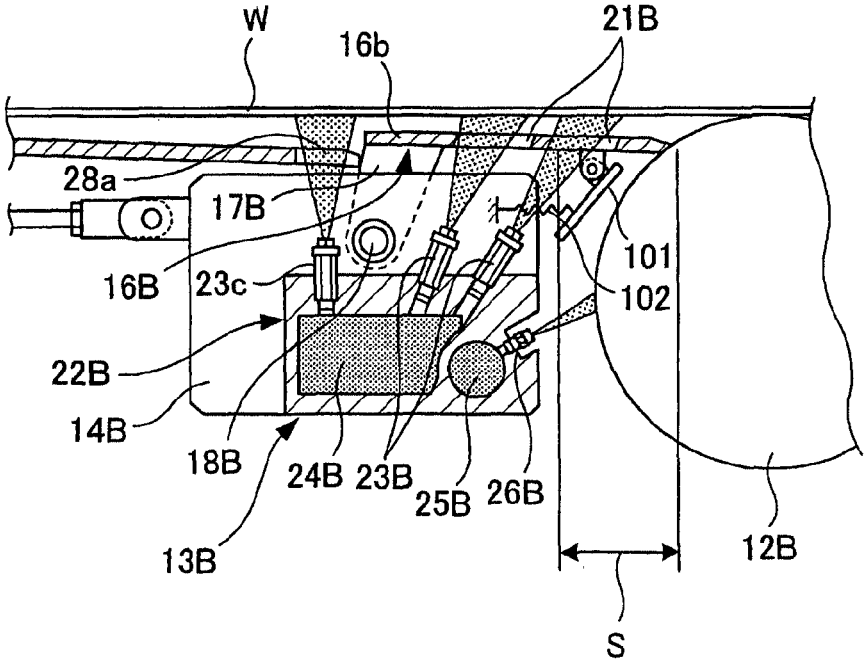
FIG. 6 is a sectional side view of an important part of the cooling system for a hot-rolled steel strip showing an example of application of a separating member.
Figure 7:
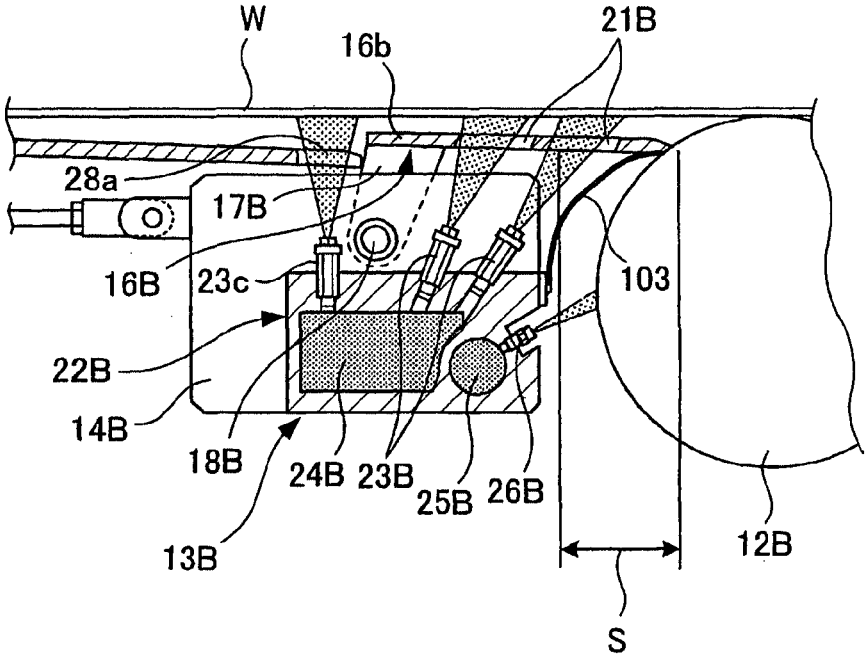
FIG. 7 is a sectional side view of an important part of the cooling system for a hot-rolled steel strip showing an example of application of a separating member.

Further, when the cooling water jetted from the roll cooling nozzles 26B should be prevented from hitting the rolled material W through the jet holes 21B of the guide 16B, or when the cooling water jetted from the roll cooling nozzles 26B should be prevented from influencing jetting of rolled material cooling water, a separating member, such as a separating member 101 in FIG. 6 or a separating member 103 in FIG. 7, is provided. The separating member 101 is caused to abut on the nozzle block 14B by a spring 102. This makes it possible to prevent the work roll cooling water, jetted from the roll cooling nozzles 26B, from hitting the rolled material W through the jet holes 21B. This also makes it possible to prevent the rolled material cooling water, jetted from the rolled material cooling nozzles 23B, from being disturbed by the work roll cooling water.

Here, it is also possible to use the separating member 101 in FIG. 6 instead of the separating plate 27 above. Further, the separating member 103 in FIG. 7 is a flexible member similar to the separating plate 27 used above in FIG. 1 so as to exert its separating function following the vertical movement of the guide 16B.

Example 2

Figure 4:
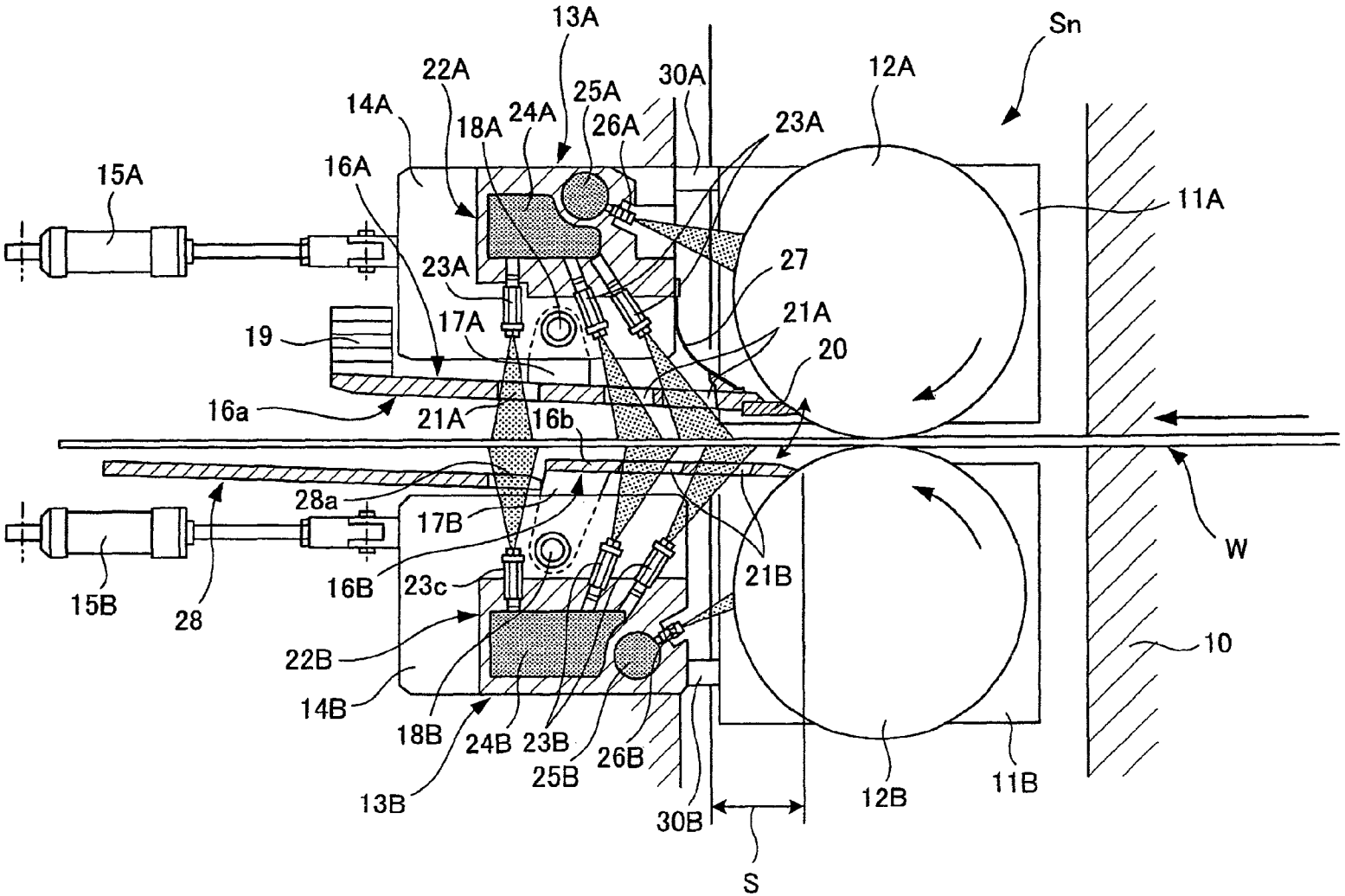
FIG. 4 is a sectional side view of a cooling system for a hot-rolled steel strip showing Example 2 of the present invention.
Figure 5A:
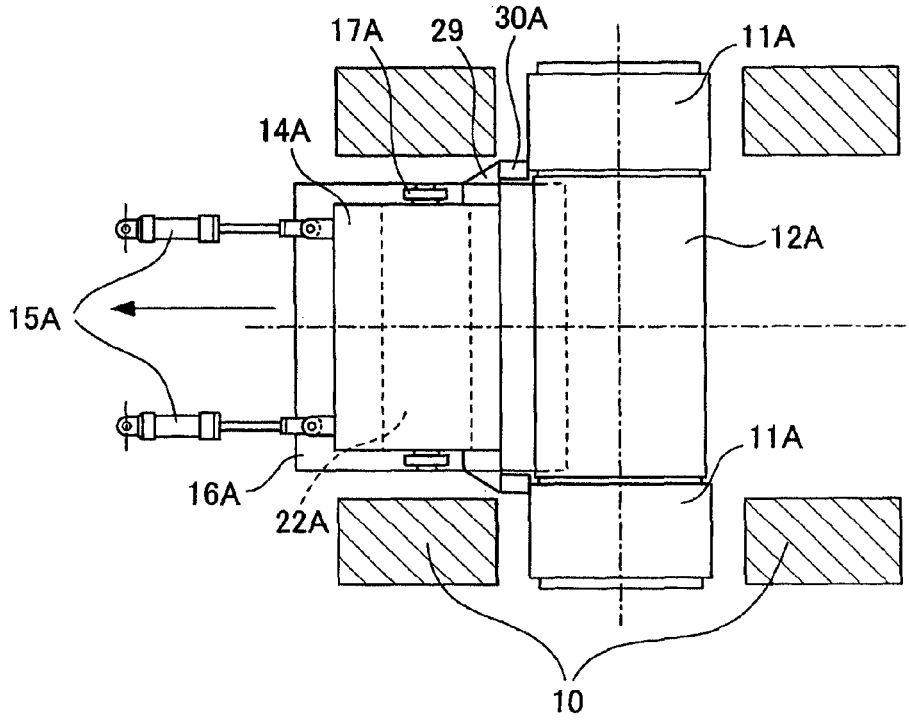
FIG. 5A is a plan view during non-cross rolling.
Figure 5B:
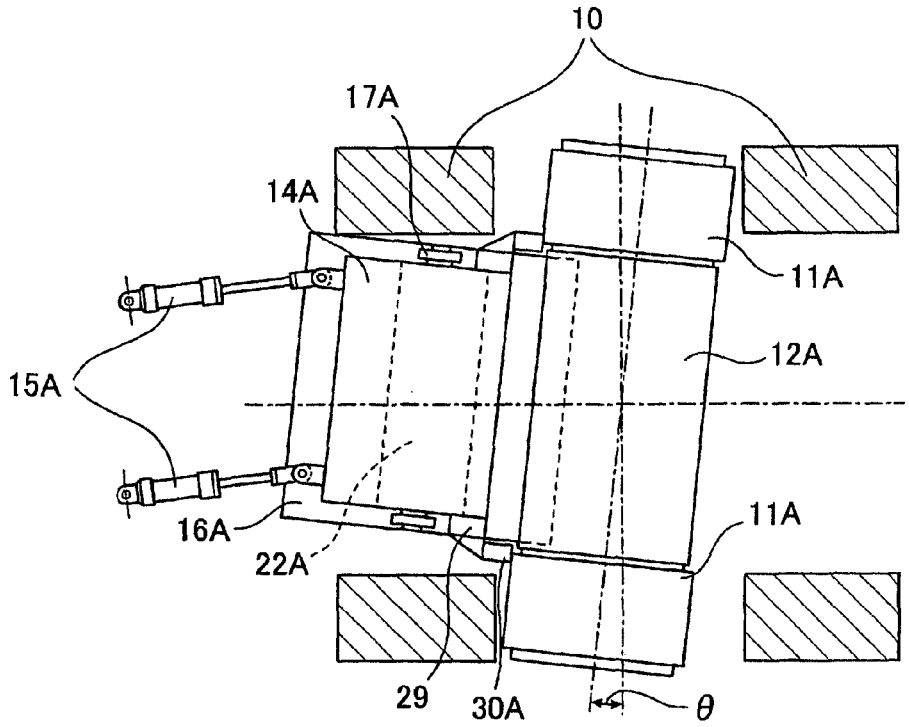
FIG. 5B is a plan view during cross rolling.

FIG. 4 is a sectional side view of a cooling system for a hot-rolled steel strip showing Example 2 of the present invention. FIG. 5A is a plan view during non-cross rolling. FIG. 5B is a plan view during cross rolling.

Example 2 is an example of application of the upper and lower cooling apparatuses 13A and 13B to a cross mill crossing the upper and lower work rolls 12A and 12B in the conveyance direction of the rolled material W.

Specifically, the pairs of right and left hydraulic cylinders 15A and 15B located above and below the rolled material W are coupled to the nozzle blocks 14A and 14B, and to the housings 10 by pins so as to be capable of horizontally pivoting, at distal ends of piston rods and at head proximal ends, respectively, and spacers 30A and 30B abutting on the upper work roll chocks 11A and 11B are attached to front sides of both the right and left portions of the nozzle blocks 14A and 14B via brackets 29. The spacers 30A and 30B are shaped and positioned so as not to block drainage. The rest of the configuration in Example 2 is the same as in Example 1, and therefore the same members as in FIGS. 1, 3A, and 3B are denoted by the same reference signs in FIGS. 4, 5A, and 5B, and overlapping descriptions are omitted.

Therefore, as shown in FIG. 5A, extending and retracting the pairs of right and left hydraulic cylinders 15A and 15B with the same stroke causes the nozzle blocks 14A and 14B and the guides 16A and 16B to be advanced and retreated relative to the upper and lower work rolls 12A and 12B, as in the case of FIG. 3A and 3B (advancing and retreating mechanism). As shown in FIG. 5B, extending and retracting the pairs of right and left hydraulic cylinders 15A and 15B with different strokes causes the upper and lower work rolls 12A and 12B to be crossed at a predetermined cross angle θ via the spacers 30A and 30B and the upper and lower work roll chocks 11A and 11B on which the spacers 30A and 30B abut (crossing mechanism).

According to Example 2, in terms of the cooling functions for the rolled material W and the upper and lower work rolls 12A and 12B, the same operation/effect as in Example 1 can be obtained, but, in terms of high reduction, since the upper and lower cooling apparatuses 13A and 13B are applied to a cross mill crossing the upper and lower work rolls 12A and 12B, higher reduction than that in Example 1 becomes possible, so that operation and effect due to high reduction and rapid cooling can be expected.

In addition, the hydraulic cylinders 15A and 15B, which are used for only the advancing and retreating mechanism in Example 1, can be used as both the advancing and retreating mechanism and the crossing mechanism of the nozzle blocks 14A and 14B and the guides 16A and 16B This makes it possible to simplify the structure and to reduce the cost.

Figure 8:
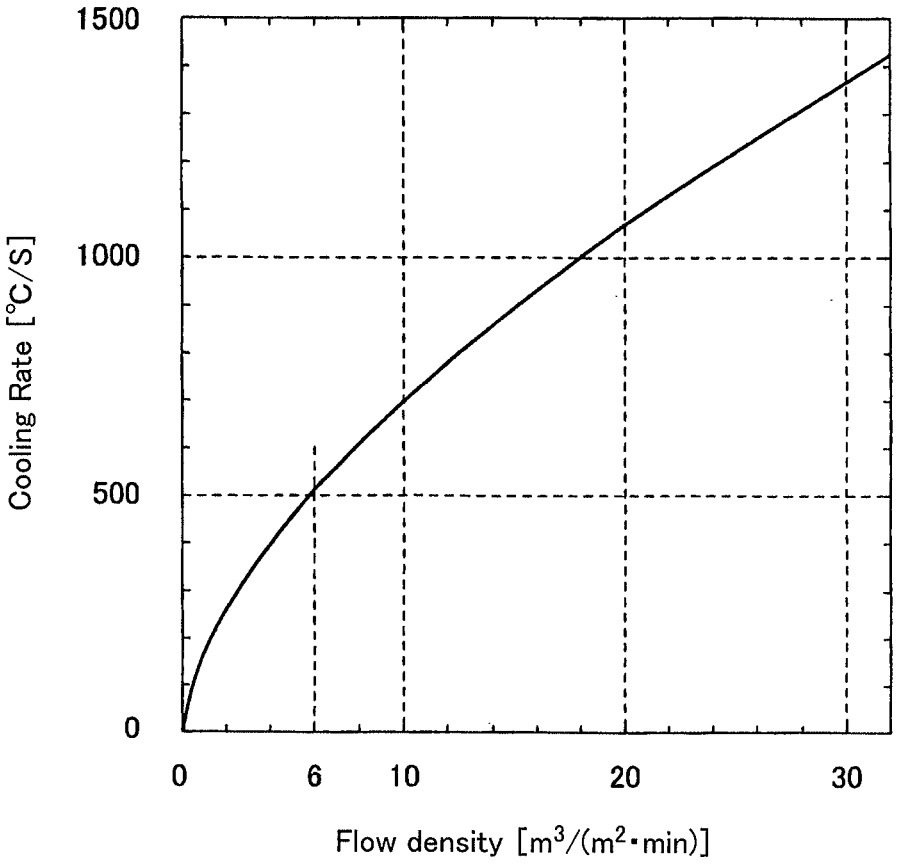
FIG. 8 is a graph showing a relation between a flow density and a cooling rate.

Further, FIG. 8 is a graph showing a relation between a flow density and a cooling rate. It is a test result of the cooling rate for a 3-mm-thick steel plate when a water-feeding pressure, namely, the pressure of the header portions for rolled material cooling water 24A and 24B is 1.5 MPa. From this test result, if the flow density (=nozzle flow rate÷widthwise nozzle pitch÷nozzle pitch in the conveyance direction) is set to 6 $m^3/(m^2 \cdot min)$ or more, a cooling rate of 500° C./s or more can be obtained for the 3 mm thick steel plate even with a water-feeding pressure of 1.5 MPa, which is used in ordinary cooling equipment, making it possible to manufacture a steel plate having a fine structure.

Further, the present invention is not limited to the above Examples, and it is obvious that without departing from the scope of the present invention, various changes are possible, such as a structural change and material change of the guides 16A and 16B, a structural change of the mechanism capable of following a crossing state, including the hydraulic cylinders 15A and 15B, a structural change of the cooling water headers 22A and 22B, and various structural combinations of the cooling water headers 22A and 22B and the header portions for work roll cooling water 25A and 25B.

INDUSTRIAL APPLICABILITY

The cooling system for a hot-rolled steel strip according to the present invention is applicable to an iron-making process line.

REFERENCE SIGNS LIST

10 HOUSING
11A, 11B UPPER, LOWER WORK ROLL CHOCK
12A, 12B UPPER, LOWER WORK ROLL
13A, 13B UPPER, LOWER COOLING APPARATUS
14A, 14B NOZZLE BLOCK
15A, 15B HYDRAULIC CYLINDER
16A, 16B GUIDE
17A, 17B BRACKET
18A, 18B PIN
19 WEIGHT
20 SOFT PLATE
21A, 21B JET HOLE
22A, 22B COOLING WATER HEADER
23A, 23B, 23C ROLLED MATERIAL COOLING NOZZLE
24A, 24B HEADER PORTION FOR ROLLED MATERIAL COOLING WATER
25A, 25B HEADER PORTION FOR WORK ROLL COOLING WATER
26A, 26B ROLL COOLING NOZZLE
27 SEPARATING PLATE
28 FIXED GUIDE
28*a* NOTCH
29 BRACKET
30A, 30B SPACER
S TRAVEL DISTANCE (ADVANCING/RETREATING AMOUNT) AT ROLL CHANGING TIME
W ROLLED MATERIAL
θ CROSS ANGLE

The invention claimed is:

1. A cooling system for a hot-rolled steel strip, comprising:

a guide provided on a delivery side of a work roll in a last stand of a hot finishing mill line, the guide including a large number of jet holes formed in the guide and a guide face for guiding a rolled material, leaving from the work roll, in a conveyance direction of the rolled materials;

roll cooling nozzles provided, on the delivery side of the work roll, for jetting cooling water to the work roll; and rolled material cooling nozzles attached to a nozzle block, for jetting cooling water directly to the rolled material through the jet holes, wherein the guide is swingably coupled by pins to the nozzle block via brackets, and is urged by a weight placed on a proximal end of the guide or by own weight of the guide such that a distal end of the guide is always brought in contact with a surface of the work roll, and capable of advancing and retreating in the conveyance direction of the rolled material via the nozzle block, and the roll cooling nozzles are attached to the nozzle block.

2. The cooling system for a hot-rolled steel strip according to claim 1, wherein a separating member is provided for preventing the cooling water, jetted from the roll cooling nozzles, from hitting the rolled material through the jet holes of the guide.

3. The cooling system for a hot-rolled steel strip according to claim 2, wherein the separating member is made of a flexible member which is connected, at one end thereof, to the guide so as to be capable of allowing the following action of the guide.

4. The cooling system for a hot-rolled steel strip according to claim 1, wherein the rolling mill is a cross mill crossing at least the work roll.

5. The cooling system for a hot-rolled steel strip according to claim 4, wherein a position adjusting apparatus making the guide capable of following the crossing state of the work roll is provided, and the position adjusting apparatus also has a function serving as a mechanism to cause the guide to advance to and retreat from the work roll.

* * * * *